US006000520A

United States Patent [19]

Dillon et al.

[11] Patent Number: 6,000,520

[45] Date of Patent: Dec. 14, 1999

[54] METHOD AND APPARATUS FOR PROTECTING A MONEY-HANDLING UNIT VULNERABLE TO LIQUID

[75] Inventors: Stephen John Dillon; Andrew Mir, both of Reading, United Kingdom

[73] Assignee: Mars, Incorporated, McLean, Va.

[21] Appl. No.: 09/029,434

[22] PCT Filed: Sep. 6, 1996

[86] PCT No.: PCT/GB96/02206

§ 371 Date: Mar. 27, 1998

§ 102(e) Date: Mar. 27, 1998

[87] PCT Pub. No.: WO97/09697

PCT Pub. Date: Mar. 13, 1997

[30] Foreign Application Priority Data

Sep. 7, 1995 [GB] United Kingdom ..... 9518649

[51] Int. Cl.[6] ..... G07F 3/00

[52] U.S. Cl. ..... 194/202

[58] Field of Search ..... 194/200, 202, 194/348

[56] References Cited

U.S. PATENT DOCUMENTS

| | | | |
|---|---|---|---|
| 3,929,213 | 12/1975 | Verrill . | |
| 4,020,478 | 4/1977 | Hatfield | 340/604 |
| 4,264,000 | 4/1981 | Burton | 194/227 |
| 4,470,496 | 9/1984 | Steiner | 194/200 |
| 4,503,963 | 3/1985 | Steiner . | |
| 5,153,564 | 10/1992 | Hoiberg . | |
| 5,237,857 | 8/1993 | Dobson et al. . | |
| 5,318,164 | 6/1994 | Barnes et al. | 194/202 |
| 5,334,937 | 8/1994 | Peck et al. . | |
| 5,377,804 | 1/1995 | Robirds . | |
| 5,398,798 | 3/1995 | Ericson | 194/202 |

FOREIGN PATENT DOCUMENTS

| | | | |
|---|---|---|---|
| 2 105 847 | 5/1972 | Germany . | |
| 1-219587 | 9/1989 | Japan | 194/202 |
| 1-250189 | 10/1989 | Japan | 194/348 |
| 2-118795 | 5/1990 | Japan | 194/348 |
| WO 93/01568 | 1/1993 | WIPO . | |
| WO 93/23829 | 11/1993 | WIPO . | |

*Primary Examiner*—Christopher P. Ellis
*Assistant Examiner*—Bryan Jaketic
*Attorney, Agent, or Firm*—Fish & Richardson P.C.

[57] ABSTRACT

A control circuit of a money-handling unit receives an input from a coin sensor, and detects whether liquid is present by detecting the occurrence of a false signal caused by liquid shorting the output of the sensor. Two different thresholds of conductivity can be used to detect whether liquid is present and to distinguish between high conductivity liquids and low conductivity liquids. The control circuit carries out different courses of action to respond to the liquid depending on the conductivity. Either a temporary or permanent shut down is selected.

56 Claims, 3 Drawing Sheets

METHOD AND APPARATUS FOR PROTECTING A MONEY-HANDLING UNIT VULNERABLE TO LIQUID

BACKGROUND

This invention relates to a method and apparatus for protecting a money-handling unit, which is vulnerable to liquid attack. Although it is not limited to the following, the invention is particularly suitable for protecting coin-validating or coin-dispensing units used, for example, in gaming machines or vending machines.

It is a known problem that vandals sometimes inject liquid into the entryway of money-operated machines in an attempt to generate false electrical signals to obtain free vend product, or a free game, or free coins.

This can be a particular problem when a multiplexed signal bus is used to carry information from sensors in the coin mechanism to a control circuit, such as in the arrangement described in WO-A-93/01568. False signals occurring on the bus could cause erroneous dispensing of change, or erroneous accumulation of credit, when none is appropriate. It is known to provide a sensor for detecting the presence of liquid, but such a sensor would need to be connected to the control circuit by at least one extra wire; if additional liquid sensors are used, this would further increase the number of inputs required for the control circuit, which defeats the advantage of using a single signal bus.

Another type of problem stems from the limited capability of conventional techniques for detecting, and for dealing with, liquid attack.

For example, U.S. Pat. No. 5,318,164 assigned to the current applicant, and U.S. Pat Nos. 4,264,000 and 5,377,804 describe systems for shutting down the supply of power to the coin-operated machine immediately on sensing a liquid. These systems remain latched of in a permanent manner until an engineer is able to service the machines and to reset the liquid-sensing system.

Such systems can provide reliable operation for protecting the electrical circuitry as well as preventing fraudulent operation. However, when an engineer attends a machine which has shut down automatically, if no permanent damage has occurred, there may be nothing in the machine that requires servicing or repair. In that case all that the engineer has to do is to perform the relatively simple task of resetting the liquid-sensing system, which in most cases is done by pressing a "reset" button. Since it is very expensive to call out an engineer to service a shut-down machine, this does not represent good value-for-money for the machine owner. Also, the engineer is unlikely to be able to attend immediately, and the machine may have to remain inoperable for some time, and therefore lose custom, even though there is nothing wrong with the machine.

Of course, the attendance of the servicing engineer is always required when such systems shut down because the owner of the machine will not generally have sufficient knowledge and experience to judge whether any permanent damage has occurred, or whether further damage or defrauding may result if operation of the machine is continued When an engineer arrives to attend to a machine which has shut down as a result of detected liquid, he will normally have to perform a complete service to check all of the parts and circuitry, even if there is no damage. This is because, assuming that the liquid has dried out, the engineer might not know which type of liquid caused the shut-down, and he will have to proceed on the assumption that permanent damage may have occurred.

Reference is also made to Japanese patent applications published under Nos. 1-219587(A), 2-118795(A) and 1-250189(A) which describe sensor circuitry for shutting down a vending machine when liquid is detected.

SUMMARY

The present invention has been devised bearing in mind the different problems discussed above.

According to one aspect of the invention, a control circuit, which receives an input on a signal line from an input device, is arranged to be able to identify the occurrence of a signal on the signal line caused by the presence of liquid providing a false conductive path.

With such an arrangement, it need not be necessary to provide a separate liquid sensor, and a separate input connection to the control circuit, in order to enable the detection of liquid. The liquid can be detected simply by identifying the occurrence of a "false" signal on the input caused by the presence of liquid.

The arrangement can also automatically protect the control circuit against any mis-operation which might otherwise be caused by responding to the "false" signal as if it were a normal input signal from the input device.

The term "input device" includes any form of detector, sensor, or input switch which provides signals to the control circuit, but it is not limited to these.

The above arrangement is particularly suitable when a multiplexed bus is used for providing signals from a number of different input devices on a common input bus. In particular, the advantage or using the bus, namely to reduce the number of separate inputs, can be retained, while still protecting the control circuit against the occurrence of "false" signals caused by liquid.

It will be appreciated that the input line and/or the input device can be arranged to be particularly exposed to any liquid in the money-handling unit, so that a primary function is to detect the presence of liquid. Alternatively, the input line and the input device can be arranged to be shielded from any liquid in the money-handling unit, the "false" signal detection being a failsafe in case any liquid does affect the input device or the input line.

In a closely related aspect of this invention, a sensing arrangement is provided for sensing a parameter, other than the presence of liquid, in a money-handling unit, and for providing an output indicative of that parameter. Means responsive to the output detects the presence of liquid by identifying the occurrence of a false low resistance condition at the output, caused by contact with liquid.

Thus with this aspect, a conventional type of sensor for sensing some other parameter can be used to detect the presence of liquid, without requiring additional circuitry or wiring connections at the sensor itself. In one form, the output leads from the sensor may simply be exposed to be contactable by any liquid present, the leads then acting as a conductivity detector in parallel with the sensor itself. Alternatively, an electrically exposed conductor may be provided in or on the body of the sensor so as to be contactable by liquid.

With this arrangement, under normal, dry conditions the output from the sensor is indicative of the sensed parameter. If liquid contacts the output to cause an electrical short or low resistance path, this will affect the signal from the sensor. However, the presence of the short, or low resistance, condition can immediately be detected to indicate the presence of liquid. This type of arrangement is particularly suitable in situations where, in the presence of liquid at the sensor, it is more important to detect the liquid than to sense the parameter for which the sensor is intended, or where it is necessary to be able to detect whether the output from the sensor has been corrupted by the presence of liquid.

In one embodiment, the sensor is arranged to provide an output signal when the sensor is enabled by an enable signal. If an output signal, such as a certain output state, is detected while the sensor is not enabled, then this indicates that liquid is present.

It will be appreciated that the liquid does not have to reduce to zero the potential difference between the output conductors, or between one output conductor and another conductor, but merely to reduce the potential difference significantly. Different liquids have different levels of conductivity; for example, tap water has only a medium conductivity, whereas saline solution has a much higher conductivity.

Turning to another problem in the prior art, in contrast to the prior techniques of performing a single liquid-responsive action, a further independent aspect of the present invention is to have available a plurality of courses of action of respond to detected liquid, and to select which of these courses of action to follow for responding to detected liquid.

This enables a system to be capable of responding to liquid in a much more versatile manner than in the above known systems. In particular, it need not be essential in all circumstances to shutdown the machine permanently and to require the attendance of a service engineer to reset the system.

Each course of action may include only one action, or it may include a number of different, and possibly consecutive, actions. The plurality of courses of action may include one or more of the following:

(i) performing a temporary or partial shutdown of one or more parts of the unit, and resuming normal operation thereafter;

(ii) performing a permanent or major shutdown of one or more parts of the unit which requires the attendance of a service engineer before normal operation can be resumed.

It is important to prevent any false operations which may result in money, or vend product, being dispensed free, or which may result in free credit being accumulated. Therefore, the temporary shutdown or partial shutdown may, for example, be achieved by inhibiting temporarily the response to input signals, to ensure that false operations do not occur. It may be possible for the machine to continue certain operations provided that other operations which are vulnerable to being affected by the presence of liquid (such as permitting manual control of a coin dispensing unit) are inhibited.

The conditions for terminating the temporary or partial shutdown can be selected as desired. For example, the shutdown may be continued until the liquid has run away or has dried out, or until a certain time-interval has elapsed. In general, it is preferred that the temporary or partial shutdown be terminated automatically, but it is also possible that the shutdown could be terminated when a secret "owner's re-start button", known only to the owner of the machine, is pressed.

The permanent shutdown may, for example, be achieved by cutting off the supply of electrical power to the one or more units being shut down, thereby ensuring that the unit will not respond even if false signals are produced which would otherwise cause mis-operation of the unit. For example, if the machine includes a coin dispensing unit, then cutting off power to this unit will prevent the possibility of "free change" being dispensed. If desired, the power supply to the entire money-handling unit can be cut off.

The permanent shutdown preferably requires the attendance of a service engineer before normal operation can be resumed. For example, an "engineer's reset button" may be provided in the money-handling unit, or an input. From an external source could be required. Alternatively, the system could be arranged to continue the shut-down until an external supply of power to the system is switched off. When the supply is again switched on, the units can operate as normal. With such a system, the "reset" operation is the switching off of the external power supply.

The above actions are merely examples, and do not limit the broad scope of the invention.

The selection of which course of action to follow may be based on one or more of various criteria. A particularly preferred feature of this invention is that the selection is made in dependence on one or more measured characteristics of the liquid.

Preferably, the one or more measured characteristics are indicative of the harmfulness of the liquid to the unit being protected. This enables an appropriate course of action to be taken to respond to a liquid depending on the extent to which the liquid is likely to affect the operation of the unit, and on whether the effect of the liquid is likely to be temporary (ie. until the liquid dries out or runs away) or more permanent (ie. requiring maintenance to be carried out by a service engineer). For example, if the measured characteristic or characteristics of the liquid indicate that it will cause a temporary disruption, then the system could follow the course of action (i), described above. On the other hand, if the measured characteristic or characteristics of the liquid indicate that it may cause permanent damage, then the system could follow the course of action (ii) described above.

An advantage of the above arrangement is that the unit is still safely shut down when liquid is detected, thereby avoiding possible damage to, and possible defrauding of, the unit, but the system does not "over-react". In one preferred embodiment, the system only remains switched-off if permanent damage is likely to have occurred.

Preferably, an electrical characteristic or property of the liquid is measured, for example, conductivity (which may be under DC conditions or AC conditions). This can enable the invention to distinguish between generally clean water which has a relatively low conductivity, and other liquids such as salt water or detergent, having a relatively higher conductivity. Clean water is a liquid which tends to cause a temporary disruption to units with electrical circuitry, but does not generally cause lasting damage once the circuitry has dried out. On the other hand, salt water and detergent are much more harmful as they tend to be corrosive to electrical circuitry and to other parts of a unit, and may thus cause permanent damage which will require the attendance of a service engineer.

The measurement of the electrical property can also be used to detect whether or not any liquid is present, in contact with the conductivity sensor. For example, in the absence of liquid, a conductivity sensor will simply register the conductivity of the ambient air in the unit, which is extremely small, and is almost zero. If a water based liquid is present, the measured conductivity will rise noticeably, in accordance with the conductivity of the liquid. Even relatively clean water has a noticeably higher conductivity than ambient air.

Other electrical or non-electrical (for example, chemical) characteristics of the liquid may be measured instead of, or in addition to, conductivity, for detecting the presence of liquid and/or for selecting a course of action to follow in response to the detection of liquid.

Broadly speaking, a fourth independent aspect of the present invention is to sense a characteristic which is suitable for detecting the presence of at least certain liquids, and to produce therefrom a signal containing first information used to determine whether a liquid is detected as being present, and second information used for distinguishing between different detected liquids.

This aspect of the invention can be used in combination with the other aspects described above. For example, in a combination with the third aspect, the first and second information can advantageously be used for selecting a course of action to follow to respond to the detection of liquid.

Alternatively or additionally, this aspect of the invention could be used for an independent purpose to provide an indication or a record of the type of liquid which has been detected.

Therefore, the invention can enable the engineer to attend to the unit in a much more efficient manner, and avoid the engineer having to waste his time in checking many parts of the unit which will not have been affected permanently by the liquid.

Preferably, the second information is based on one or more characteristics which are indicative of the harmfulness of detected liquid to the unit being protected. More preferably, the second information distinguishes between liquids on the basis of how harmful they may be to the unit. For example, the second information may distinguish between a liquid having a predetermined characteristic which indicates that the liquid will cause only a temporary disruption to the unit, and a liquid which has a predetermined characteristic which indicates that the liquid may cause permanent damage.

Preferably, the sensed characteristic is electrical conductivity. Liquid is detected as being present when the conductivity rises above a first threshold. A second conductivity threshold, representing a higher conductivity than the first conductivity threshold, can be used to distinguish between high conductivity liquids, and low conductivity liquids.

Each threshold determination may be performed using a dedicated comparator circuit, or it may be performed using a digital circuit which simply treats a signal below a certain level as a logic-low signal, and a signal above that level as logic-high signal.

The testing of the measured conductivity value could also be performed by software in a programmed computer processor or in a micro-controller. In that case an analogue-to-digital converter may be employed for converting an analogue value representing the conductivity to a digital value suitable for digital processing.

In one embodiment, a measured value of conductivity is compared with a first relatively low threshold to ascertain whether it has risen above the first threshold, indicative that liquid is present. As explained above, even low conductivity liquid has a noticeably higher conductivity than ambient air. The measured value may also be compared with a second threshold higher than the first threshold and set, for example, to distinguish between "low conductivity" liquid and "high conductivity" liquid. As explained above, this can enable the system to distinguish between clean water on the one hand, and salt water or detergent on the other.

Further thresholds may also be employed to test against the measured value of conductivity to further identify or classify the detected liquid.

In one form, the testing may be performed entirely by hardware circuitry which consists of two comparator circuits coupled in parallel to receive an analogue signal representing the measured conductivity. The first and second thresholds are set by means of resistors which are coupled to the comparators as potential dividers. The first comparator compares the input signal with the first threshold and the comparator output represents the first information. The second comparator compares the input signal with the second threshold, and the comparator output represents the second information.

Broadly speaking, a further aspect of the invention is to sense the electrical conductivity of a liquid introduced in a money handling unit vulnerable to liquid, to produce an electrical signal indicative of the magnitude of the conductivity, to compare the signal with first and second threshold values, and to produce a first output signal if the conductivity signal exceeds the first threshold, and a second output signal if the conductivity signal exceeds the second threshold.

Broadly speaking, a further aspect of the invention is to sense one or more characteristics suitable for the detection of at least certain liquids, determining from the sensed characteristic or characteristics whether a liquid of a first type is present and, if so, carrying out a first course of action to respond to the detected liquid, and determining from the sensed characteristic or characteristics whether a liquid of a second type is present and, if so, carrying out a second course of action to respond to the detected liquid.

The invention provides apparatus and methods for carrying out the independent aspects of the invention described above.

BRIEF DESCRIPTION OF THE DRAWINGS

Embodiments of the invention are now described by way of example, with reference to the accompanying drawings, in which.

DETAILED DESCRIPTION

Figure 1:
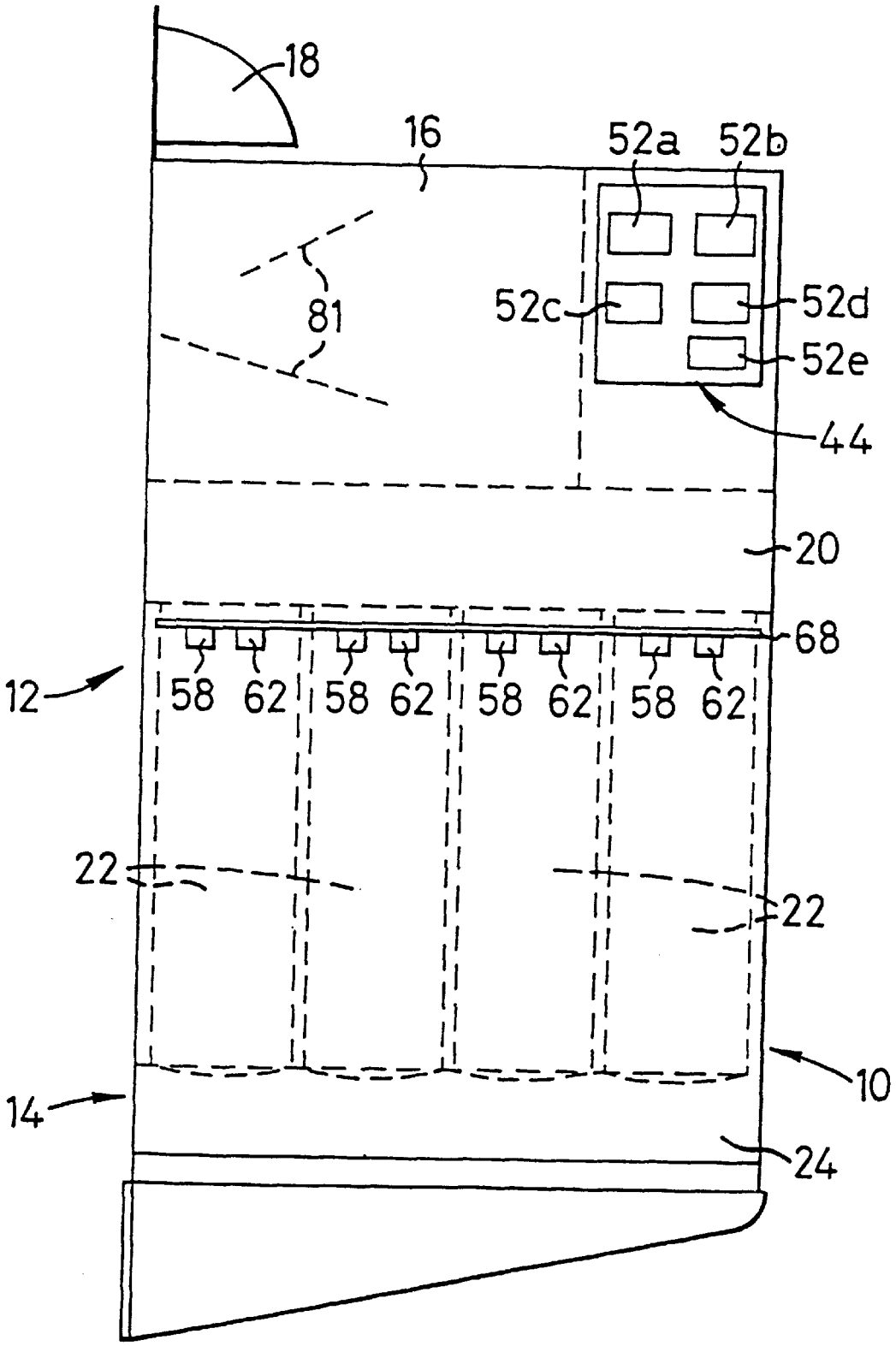
FIG. 1 is a schematic view of a money-handling mechanism in a money-operated machine.

In FIG. 1, parts of a coin mechanism 10 mounted behind a facia panel 14 of a coin-operated machine 12, are represented in block schematic form. These parts are conventional, and so are described only briefly herein. A coin validating section 16 receives a coin introduced through an entry slot 18, and passes the coin, if it is determined to be acceptable, to a coin routing mechanism 20 for routing the coin into a respective coin storage tube 22, according to the coin's denomination. A dispensing mechanism 24 is operable to dispense coins from, for example, the lower end of the coin tubes, to provide change or a refund.

Figure 2:
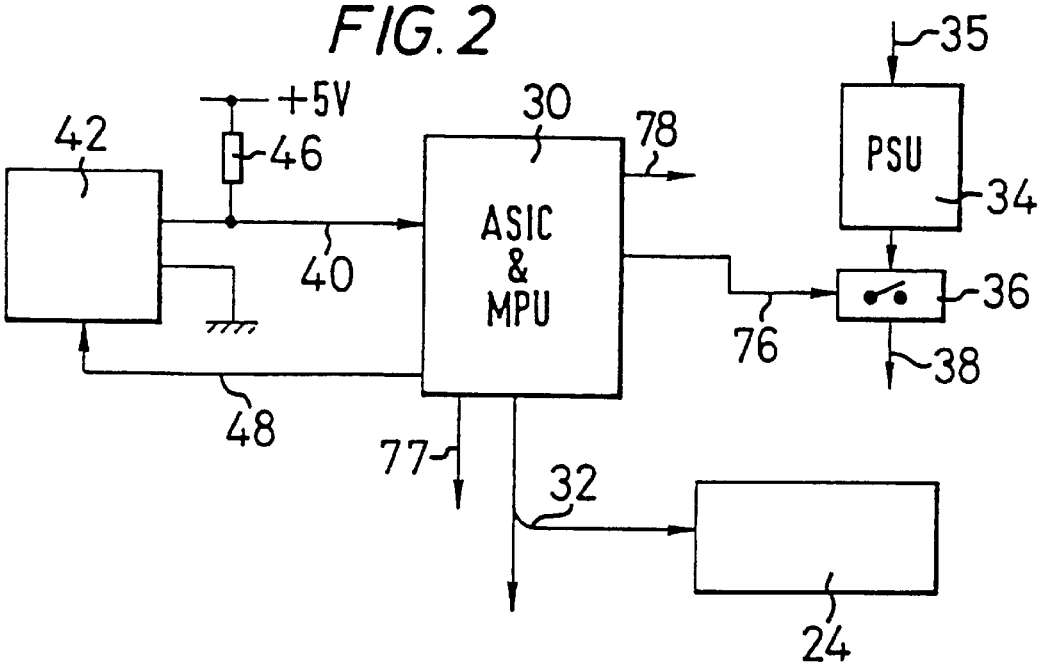
FIG. 2 is a block diagram of control circuitry of the money-handling mechanism.

The coin mechanism operates under the control of a controller circuit 30 (FIG. 2) which, in this exemplary embodiment, includes an ASIC and a microcontroller which together control operation of coin routing gates throughout the coin mechanism, and control operation of the dispensing mechanism 24 by means of a control output bus shown generally at 32. Power for the circuitry is supplied from a power supply unit 34 which receives power from an external power-in line 35. An electrically operated cut-off switch 36 is provided for cutting off the supply of power on line 38 which feeds power to the controller 30 and other coin mechanism circuitry.

The controller 30 receives inputs on an input bus 40 from at least one input device 42. Typically this input device may be a sensor for detecting the presence or passage of a coin, or a feedback sensor for sensing the condition of a coin gate or actuator in the coin mechanism. The input device 42 may also be a keyboard (44 in FIG. 1) which enables an engineer to control the dispensing mechanism 24 manually, for example, if money needs to be returned to a customer in the event of a fault. Typically a number of different input devices will be coupled in parallel to the input bus 40 using a multiplexing technique, such as the technique described in WO-A-93/01568.

In order to protect the coin mechanism 10 from accidental or, more seriously, malicious introduction of liquid through the entry slot 18, the circuitry is arranged to detect the presence of liquid in the coin mechanism 10.

In one example of the present invention, the controller 30 is arranged to detect the occurrence of a signal on the input bus 40 caused by liquid providing a false conductive path or short circuit. In this embodiment, the input bus 40 is biased to a fixed potential, for example, to logic-high level, by means of a pull-up resistor 46. The input device 42 is arranged so that, when enabled by a signal on the enable line 48 from the controller 30, it can either leave the bus 40 biased to logic-high to represent a logic-high input to the controller 30, or it can pull the input bus 40 to ground to send a logic-low signal to the controller 30 (in a similar manner to TTL type logic circuits).

The controller 30 detects the presence of liquid by detecting the occurrence of a logic-low signal on the input bus when the enable line 48 is not active. If any liquid comes into contact with the connections to the input bus 46 such that it provides a conductive path to ground potential, this will provide a false conductive path to pull the input bus 40 to a logic-low level. It will be appreciated that different liquids have different levels of conductivity. However, by suitable selection of the value of the pull-up resistor 46, even if the liquid is of modest conductivity (such as normal tap water), the voltage level on the input bus 40 can be made to fall below about 3 volts, which is sufficiently low for the controller 30 to treat the voltage as logic-low. of course, in the presence of higher conductivity liquids, the voltage will be pulled even lower.

Figure 3:
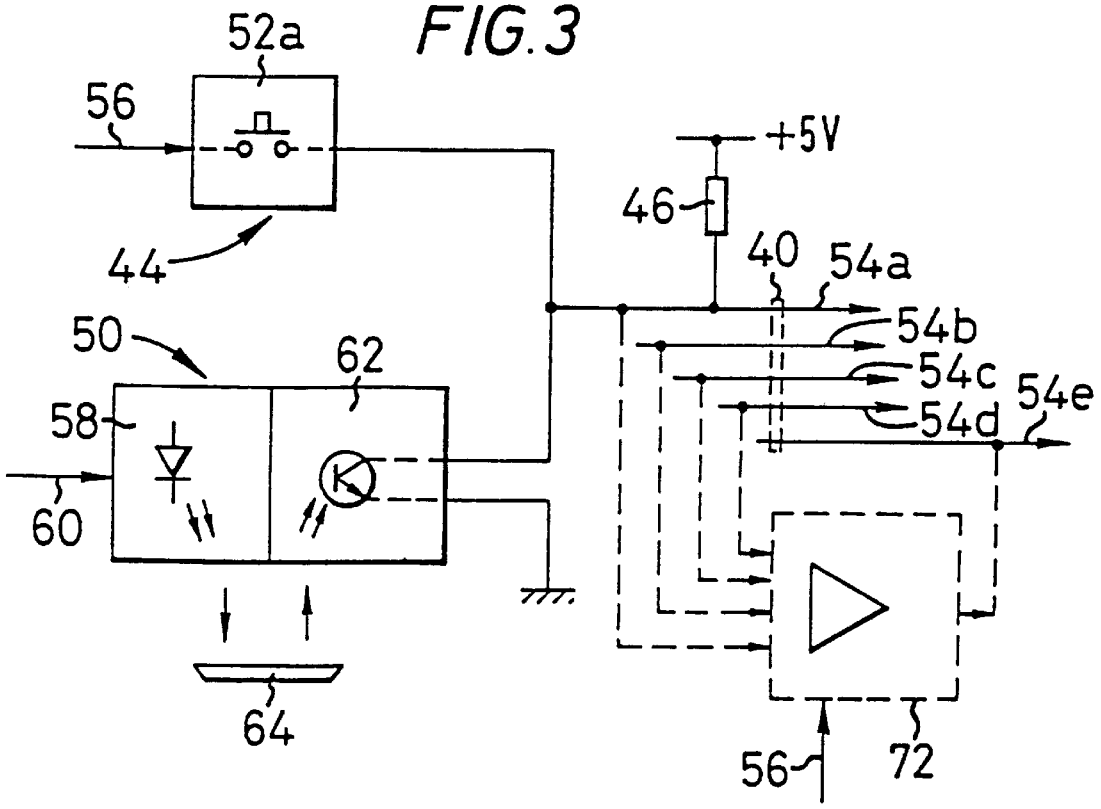
FIG. 3 is a schematic circuit diagram showing one embodiment in more detail.

In a particular embodiment, the input bus 40 is coupled to a keyboard 44 mentioned hereinbefore, and to an arrangement of top-level detectors 50 for detecting whether each coin tube is full. FIG. 3 illustrates circuitry for one signal line 54*a* of the input bus 40. The keyboard 44 illustrated has five key switches 52*a–e*, each coupled to a respective one of five input channels or lines 54*a–e* of the input bus 40. When the controller 30 takes a keypad enable line 56 active-low, (which enables all of the key switches simultaneously) if a key is currently being pressed the respective input line 54 will be pulled to a logic-low level; otherwise, the input line will remain at the logic-high level.

There are four top-level sensors 50, one for each coin tube 22, and these are connected to the first four (54*a–d*) of the five input lines 54*a–e* of the input bus 40. Each top-level sensor consists of a LED optical emitter 58 driven by an optic enable line 60, and a photosensor 62 coupled between ground and a respective one of the signal lines 54. When an active signal is applied to the optic enable line 60, each emitter 58 emits light across the upper end of the respective coin tube 22. If the coin tube is not full, the light beam crosses the coin tube and is reflected by a prism 64 back to the photosensor 62, causing the photosensor 62 to conduct, and thereby pull the signal line 54 to low level. If the coin tube is full, the uppermost coin obstructs the light beam, and no light reaches the photosensor 62. Under this condition, the photosensor remains non-conducting, and the signal line 54 remains at high level.

Figure 4:
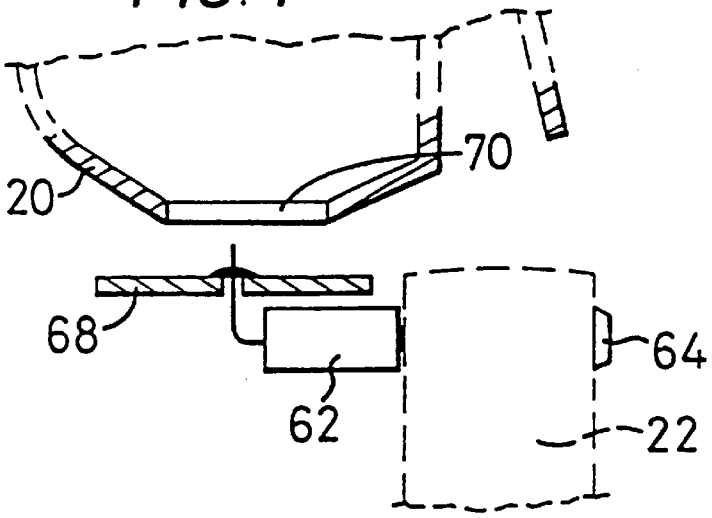
FIG. 4 is a section showing a detail of FIG. 1.

The connections to the photosensors 62 provide convenient exposed terminals to be contacted by liquid if it is present. As best seen in FIGS. 1 and 4, the emitters 58 and the photosensors 62 are carried on a circuit board 68 which is mounted under the coin-routing mechanism 20. In this embodiment, the emitters 58 and photosensors 62 are Positioned on the underside of the circuit board 68, and their leads project upwardly through holes in the board and are soldered to conductive tracks on the upper face of the circuit board 68. The circuit board 68, and the coin routing mechanism 20 are so arranged that, if liquid is injected into the entry slot, at least some of the liquid will run down through the coin routing mechanism 20 to land on the circuit board 68. For example, the housing of the coin routing mechanism may have openings or gaps (70) which allow the liquid to run out on to the circuit board. On the circuit board itself, the liquid may either provide a false conductive path directly between two adjacent conductive tracks if the tracks are not protected by an insulating film, or it may contact the soldered connections to the leads. It will be appreciated that, owing to capillary action, the fluid may tend to collect around the upstanding solder connections to the leads. Further, the relatively close spacing of the leads enables the detection of even small quantities of liquid on the circuit board.

It will He appreciated generally that connection of the keyboard 44 to the controller 30 by means of a general input bus 40, although desirable to reduce the number of separate inputs to the controller 30, makes the circuit vulnerable to liquid. If no liquid detection were to be provided, false signals caused by liquid contacting the input bus 40 could be interpreted incorrectly by the controller as command signals from the keyboard to operate the coin dispensing mechanism 24, resulting in coins being dispensed free to a customer. However, with the above described arrangement, this problem can be overcome easily and reliably without requiring additional sensor circuitry.

Although in the above embodiment, the circuitry is so arranged that any liquid present is likely to affect input bus 40 and be detected, this need not be so in all embodiments. For example, the input bus could be arranged to try to protect it from any liquid present, and with the invention then used as a failsafe to detect false signals occurring on the input bus in case the liquid does reach it.

In the above embodiment, only four (54*a–d*) of the five input lines 54*a–e* of the input bus are coupled to the circuit board 68, and are affected by liquid. The fifth input line 54*e* may remain reliable even if the other four input lines 54*a–d* have been "shorted" to ground by the liquid. As one example, the key switches 52*a–d* coupled to the first four input lines 54*a–d* could be used to control the coin dispenser 24 to dispense coins from the four coin tubes 22, because the occurrence of false signals on these input lines will automatically be detected. The fifth key switch 52*e* coupled to the fifth input line 54*e* not affected by liquid, can be used as a "reset" switch.

The action taken by the controller 30 when liquid is detected may be limited to a single fixed action, or it may be pre-selected by the owner of the machine from a choice of possible actions. Such actions may include, for example:

(a) sending a signal on line 76 to control the power switch 36 to cut-off the power supply on the power line 38, and thereby prevent any further operation of the coin mechanism and, in particular, of the dispensing mechanism; or (b) setting a flag register in the controller 30 in order to instruct the controller 30 to inhibit any further output control signals to the coin dispensing mechanism 24, or to inhibit response to any further input signals from the input bus 40 (or from the affected or vulnerable input lines of the bus) for the purpose of control.

It is important that sufficient action is taken to inhibit false operation of the coin dispensing mechanism 24. If desired, action can also be taken to inhibit signals on the vend control line 77 which provides vend enable signals to the vending machine (not shown). By inhibiting the vend control line 77, false operation of the vending machine can thus be prevented.

The action could continue either:

(c) until the "reset" button 52*e* is pressed; or (d) until a predetermined "reset" operation is carried out; or (e) until a predetermined "drying out" time has elapsed; or (f) until the signals on the input bus 40 indicate that the liquid has dried out; or a combination of any of these.

In particular, in the case of option (a) described above, the switch 36 can be arranged to remain in a latched "off" condition cutting off the supply to power line 38. For example, a latching relay could be used. It will be appreciated that power will still be supplied from the power supply unit 34 to power the relay in its latched condition. To reset the relay, the reset operation (option (d)) could simply be to switch off the external supply to line 35, thereby causing the relay to return to its unlatched "on" condition. When the external power is switched on again, power will then be supplied to the whole coin mechanism, allowing normal operation.

A further option, which is described in the following modified embodiment, is for the controller 30 to select an appropriate course of action to follow to respond to detected liquid in dependence on one or more detected parameters of the liquid. The conductivity of the liquid is analyzed to determine whether the liquid is a high conductivity liquid or a low conductivity liquid.

Referring to FIG. 3, in the modified embodiment a comparator circuit 72 is coupled to at least one, but preferably to each, of the four input lines 54*a–e* which are coupled to the photosensors 62 on the circuit board 68. It will be appreciated that a low conductivity liquid would tend to pull the signal lines 54 down to about 3 volts, whereas a higher conductivity liquid would tend to pull the signal lines 54 to a lower voltage, for example, below about 1 volt. The comparator circuit 72 detects whether any of the signal lines to which it is connected falls below a predetermined threshold (For example, about 1 volt) for distinguishing between a high conductivity liquid and a low conductivity liquid, and provides an output on the fifth signal line 54*e* (pulling the signal 54*e* to a logic-low level) if the voltage on any line is below the threshold. The comparator circuit 72 is arranged to provide the output only if the keypad enable line 56 is not active, so that it does not interfere with the signals from the keypad. Alternatively, a comparator enable line could be provided to control the comparator circuit, but this would necessitate an additional connection from the controller 30.

Therefore, in this embodiment, the signals on the four input lines 54*a–d* coupled to the photosensors 62 provide information as to whether any liquid is present, irrespective of whether it is of high or low conductivity. The signal on the fifth input line 54*e* provides information as to whether the liquid is of high conductivity or of low conductvity, in order to distinguish between different types of liquid.

Low conductivity liquid (eg. tap water) is treated as requiring only temporary shut-down in the coin mechanism (in particular, of the dispensing mechanism). This can be achieved by either of the actions in option (b) mentioned above, to prevent operation of the dispensing mechanism 24. Normal operation can be resumed automatically by the controller 30 by either the options (e) or (f) mentioned above.

Corrosive liquids, such as detergent or saline solution tend to have a much higher conductivity than clear water. The controller 30 treats all high-conductivity liquids as potentially corrosive, and capable of causing permanent damage. To deal with this, the controller 30 performs a major shut down by using action (a) mentioned above so that the switch 36 remains in a latched-off condition. In order to resume normal operation, a service engineer has to be called out to service the coin mechanism and, after having repaired any damage, to reset the power switch 36, for example, as described above.

The controller 30 provides an output 78 indicative of its status. In this embodiment, the output 78 can indicate one of three states, namely: (i) normal (no liquid); (ii) temporary shutdown (for liquids which do not have a high conductivity); or (iii) permanent shutdown (for high conductivity liquids). The output 78 can be used to trigger an alarm depending on the operating status. If the unit is coupled to a telephone line or to a communication bus or line, then the output 78 can be used to generate a suitable communication signal to indicate the status of the unit to a remote monitoring station.

It will be appreciated that the above described system can offer substantial benefits over conventional liquid-responsive systems. The system provides the same protection against liquids, in that operation of the machine is stopped immediately when a liquid is detected, to prevent fraudulent operation or misuse. However, the system does not "over-react"; the system can resume normal operation after an interval if the liquid is determined not to be permanently damaging, so that the coin-operated machine does not lose custom unnecessarily. On the other hand, if the liquid is determined to be permanently damaging, a permanent shut-down is performed, to prevent further possible damage, and to prevent the possibility of fraud.

In the embodiments described above, the keypad is an engineer's keypad which is not normally accessible to a customer. However, it will be appreciated that additionally, or alternatively, an input from a customer-operated keypad could be disabled to inhibit certain operations of a vending or game machine.

Although the embodiments described above detect liquid by the the presence of a low resistance condition on the input bus 40, one or more discrete liquid sensors could also, or alternatively, be provided for detecting the presence of liquid, and for providing discrete output signals to the controller 30.

Figure 5:
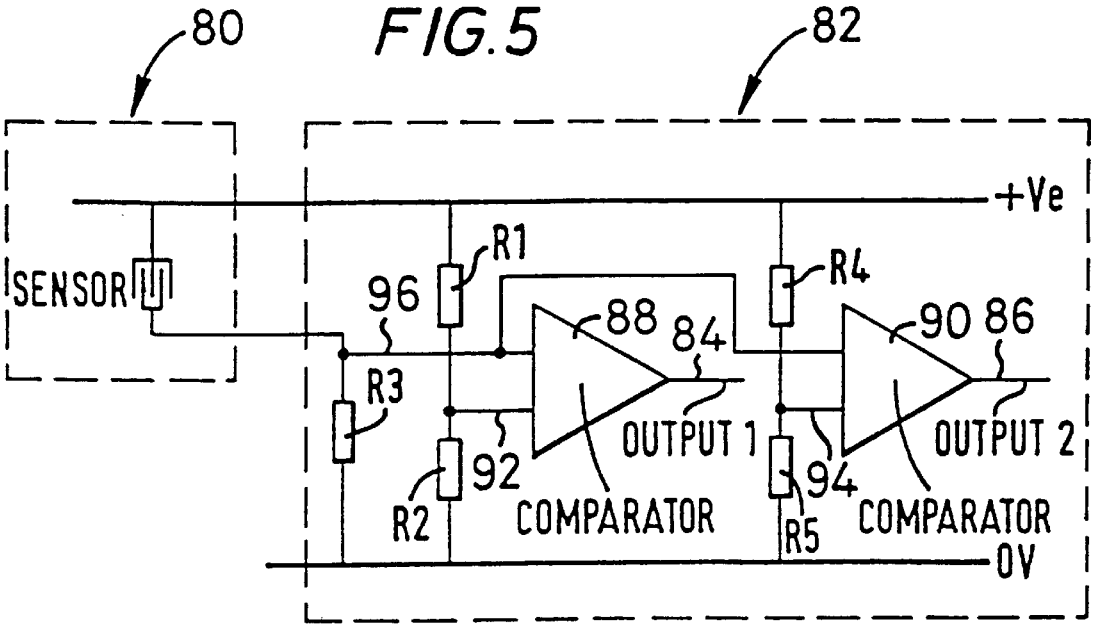
FIG. 5 is a schematic circuit diagram of sensor circuitry for use in a further embodiment.

In the further embodiment illustrated in FIG. 5, at least one discrete conductivity sensor 80 is used to detect the presence of liquid, and to distinguish between different types of liquid. The sensor can be located at a strategic position in the coin mechanism 10 to detect liquid, such as on the circuit board 68 (or other board) below the coin routing mechanism 20, or at the entry slot 18, or in one or more of the usual coin runways (depicted by lines 81 in FIG. 1) in the coin validator 16, or at the bottom of the coin mechanism at which liquid may collect.

Any form of conductivity sensor may be used, for example, two parallel electrode plates formed on or in the runway 81, or a plurality of such contacts connected in parallel to provide a "distributed" sensor.

The sensor 80 is coupled to a discriminator circuit 82 which outputs a first information signal on line 84 indicative of whether a liquid has been detected, and a second information signal on line 86 for discriminating between different detected liquids on the basis of the measured conductivity.

The discriminator circuit 82 consists of two comparators 88 and 90 coupled in parallel to the sensor 80. The first comparator is set with a relatively low threshold (high sensitivity) to provide a signal on line 84 when the conductivity exceeds the low threshold, and the second comparator is set with a relatively high threshold (low sensitivity) to provide a signal on line 86 when the conductivity exceeds the high threshold.

The reference or threshold voltage for the first comparator 88 is set at input 92 by two resistors R1 and R2 coupled in series across the power supply rails as a potential divider. The reference or threshold voltage for the second comparator is likewise set at input 94 by two further resistors R4 and R5. The sensor 80 is coupled to a load resistor R3 to form a potential divider giving a sensed voltage at node 96.

Under normal operating conditions, the sensor 80 is in contact with ambient air, which has a very low conductivity. Therefore, the resistance of the sensor 80 is much higher than R3, and the voltage at node 96 is lower than both of the threshold voltages of the comparators. Under these circumstances, the outputs on both of lines 84 and 86 are low, which indicates to the controller 30 that no liquid is present.

If clean water (eg. tap water) is injected through the entry slot 18, the conductivity of the sensor 80 will rise noticeably, since tap water has a "medium" conductivity compared to the low conductivity of ambient air. Therefore, the resistance across of the sensor 80 will drop, and the voltage at node 96 will rise to a "medium" voltage greater than the low threshold set by the resistors R1 and R2, but less than the high threshold set by the resistors R4 and R5. Under these circumstances, the output on line 84 goes high, and the output on line 86 remains low, which indicates to the controller 30 that a liquid has been detected but that it does not have a high conductivity.

Once the liquid has dried, or has drained away, the sensor 80 will return to the normal low conductivity condition, and both output lines 84 and 86 will go low.

If a high conductivity liquid is injected through the entry slot 18, the conductivity of the sensor 80 will rise to a high level. Therefore, the resistance across the sensor 80 will be low, and the voltage at node 96 will rise to a high level, greater than the high threshold set by the resistors R4 and R5 (and, of course, greater than the low threshold set by the resistors R1 and R2). Under these circumstances, the outputs on both lines 84 and 86 will go high, which indicates to the controller 30 that a high conductivity liquid has been sensed.

If more than one sensor 80 is provided, a discriminator circuit 82 can be provided for each sensor 80, and the outputs coupled in parallel (logical "OR") to the controller 30 so that the controller can respond to a liquid detected by any sensor. It may also be desired to couple more than one sensor to a single discriminator circuit, in order to reduce the cost of providing a separate discriminator for each sensor. However, since the discriminator would, in effect, be working on an average sensed signal, this might be less reliable than the above preferred arranged in which each sensor is monitored independently. A further option may be to multiplex the sensors, so that each sensor can be monitored independently in turn.

In this specification, the terms "money" and "coin" are intended to include coin-like tokens, whether or not they are official or convertible currency, and (where appropriate) counterfeit coins or "slugs", and the term "coin mechanism" and "money-handling unit" are intended to include a mechanism which is intended selectively to receive and/or issue such tokens and the like, treating them as items of value.

Although the system has been described above in the context of a coin-operated vending machine, the system is suitable for use in any money-handling apparatus, including banknote-handling apparatus as well as coin-handling apparatus or apparatus which can handle both coins and banknotes, particularly for "stand alone" units which are intended to operate autonomously.

It will be appreciated that the above description is merely illustrative of preferred embodiments of the invention, and that many modifications may be made within the scope or principles of the invention.

What is claim is:

1. Money-handling apparatus comprising a control circuit and an input device which provides an input, representing an input parameter unrelated to liquid detection, on a signal line to the control circuit, the control circuit being operable to identify the occurrence of a signal on the signal line caused by the presence of liquid and to distinguish between such a signal and a parameter-representative input.

2. Apparatus according to claim 1, wherein the input device comprises a sensor for sensing the presence of a coin.

3. Apparatus according to claim 1 or 2, wherein the input device comprises manually operable switching means.

4. Apparatus according to claim 3, wherein the manually operable switching means comprises a manual switch for controlling manually the dispensing of money.

5. Apparatus according to claim 1, wherein the signal line is biased to a predetermined voltage, and wherein the control circuit is operable to detect that the voltage has changed to a different level caused by current leakage.

6. Apparatus according to claim 1, wherein the input device is arranged to provide a signal at predetermined time intervals, and wherein the control circuit comprises means for detecting a signal at time periods other than said predetermined time intervals.

7. Apparatus according to claim 6, comprising a plurality of input devices coupled to the signal line, and means for respectfully enabling the input devices to produce signals on the signal line.

8. Apparatus according to claim 1, comprising a plurality of input devices and a plurality of signal lines, the control circuit being responsive to each of the signal lines for detecting the presence of liquid.

9. Apparatus according to claim 1, wherein the signal line is biased to a predetermined voltage, the voltage level at the output being dependent on whether liquid provides a low resistance path, and wherein the control circuit comprises means responsive to the voltage level on the signal line.

10. Apparatus according to claim 9, wherein the input device is arranged to provide the input when enabled by an enable signal, and wherein the control circuit is responsive to said voltage level when the input device is not enabled for detecting the presence of liquid.

11. Apparatus according to claim 1, further comprising means for carrying out a course of action to respond to the detection of liquid.

12. Apparatus according to claim 1, wherein the input device comprises sensor means located adjacent to a runway for a coin.

13. Apparatus according to claim 1, wherein the input device comprises sensor means located on a circuit board.

14. Apparatus according to claim 1, wherein the input device comprises sensor means located adjacent to a circuit board.

15. Apparatus for protecting a money-handling unit vulnerable to liquid, comprising means for sensing one or more characteristics indicative of the presence of at least liquids of first and second types, means for determining from the sensed characteristic or from at least one of the sensed characteristics whether the liquid of a first type is present and, if so, for carrying out a first of a plurality of predetermined courses of action to respond to the detected liquid, and means for determining from the sensed characteristic or from at least one of the sensed characteristics whether a liquid of the second type is present and, if so, for carrying out a second of the plurality of courses of action to respond to the detected liquid.

16. Apparatus according to claim 15, wherein the sensing means is operable to sense a characteristic of the liquid which is indicative of the harmfulness of the liquid.

17. Apparatus according to claim 15, wherein the sensing means is operable to sense an electrical characteristic.

18. Apparatus according to claim 17, wherein the electrical conductivity is sensed.

19. Apparatus according to claim 18, adapted to carry out different courses of action in dependence on whether a liquid is detected to have a relatively high conductivity, or a relatively low conductivity.

20. Apparatus according to claim 17, wherein the apparatus detects whether or not a liquid is present according to the sensed electrical characteristic.

21. Apparatus according to claim 15 wherein a course of action to respond to the detection of liquid comprises inhibiting at least certain operations of the unit temporarily, and restoring full operation of the unit automatically thereafter.

22. Apparatus according to claim 21, wherein said operations are inhibited by preventing the generation of control signals for controlling said operations.

23. Apparatus according to claim 22, wherein the generation of said control signals is prevented by inhibiting a response to input signals by which the control signals are normally generated.

24. Apparatus according to claim 15, wherein a course of action to respond to the detection of liquid comprises inhibiting at least certain operations of the unit in a generally invulnerable manner to prevent operation thereof until a predetermined manual reset operation is carried out to reset the apparatus.

25. Apparatus according to claim 24, wherein the inhibiting of at least certain operations is carried out by cutting off the supply of electrical power to at least certain components.

26. Apparatus according to claim 21, wherein operation of a coin dispensing mechanism is inhibited.

27. Apparatus according to claim 21, wherein operation of a vending mechanism is inhibited.

28. Apparatus according to claim 18, wherein the conductivity sensor comprises spaced electrodes for passing a current through a medium in contact with the electrodes to measure the conductivity of the medium.

29. Apparatus for protecting a money-handling unit which is vulnerable to liquid, the apparatus being capable of controlling the unit to follow a plurality of different courses of action to respond to detected liquid, and the apparatus comprising means for selecting which course of action to follow for responding to the detected liquid in dependence on a sensed characteristic of the liquid.

30. Apparatus according to claim 29, further comprising a sensor for producing an electrical output signal representative of a characteristic to be sensed.

31. Apparatus according to claim 29, comprising sensor means located adjacent to a runway for a coin for sensing the characteristic.

32. Apparatus according to claim 29, comprising sensor means located adjacent to a circuit board for sensing said characteristic.

33. Apparatus according to claim 29, wherein the sensed characteristic is indicative of whether the liquid is of a first type or a second type.

34. Sensing apparatus for use in a system for protecting a money-handling unit which is vulnerable to liquid attack, the sensing apparatus comprising means for sensing a characteristic which is suitable for indicating the presence of liquid and for distinguishing between different types of liquids, and means for deriving from the sensed characteristic a signal indicative of whether a liquid is detected to be present and, if a liquid is present, indicative of which type of liquid has been detected.

35. Apparatus according to claim 34, wherein the sensed characteristic is an electrical characteristic.

36. Apparatus according to claim 35, wherein the electrical characteristic is electrical conductivity.

37. Apparatus according to claim 34, wherein the signal is dependent on whether the sensed characteristic exceeds a predetermined threshold indicative of the presence of a liquid.

38. Apparatus according to claim 34, wherein the signal is dependent on whether the sensed characteristic exceeds a predetermined threshold for distinguishing between high conductivity and low conductivity liquids.

39. Apparatus according to claim 36, wherein the conductivity sensor comprises spaced electrodes for passing a current through a medium in contact with the electrodes to measure the conductivity of the medium.

40. Apparatus according to claim 34, wherein the sensing means is located adjacent to a runway for a coin.

41. Apparatus according to claim 34, wherein the sensing means is located adjacent to a circuit board.

42. Sensing apparatus for use in a system for protecting a money-handling unit which is vulnerable to liquid, the sensing apparatus being capable of distinguishing between different liquids and comprising sensor means for sensing electrical sensor conductivity and for producing an electrical signal indicative of the magnitude thereof, and comparator means for comparing the sensor signal with first and second thresholds, and for producing a first output signal if the sensor signal exceeds the first threshold, a second output signal if the sensor signal exceeds the second threshold, and third output signal if the sensor signal does not exceed either threshold.

43. Apparatus according to claim 42, wherein the comparator means comprises a first comparator circuit for comparing the sensor signal with the first threshold, and a second comparator circuit for comparing the sensor signal with the second threshold.

44. Apparatus according to claim 42 wherein the sensor means comprises spaced electrodes for passing a current through a medium in contact with the electrodes to measure the conductivity of the medium.

45. Apparatus according to claim 42, wherein the sensor means is located in a runway for a coin.

46. Apparatus according to claim 42, wherein the sensor means is located on a circuit board.

47. Apparatus according to claim 42, wherein the sensor means is located adjacent to a runway for a coin.

48. Apparatus according to claim 42, wherein the sensor means is located adjacent to a circuit board.

49. A method of operation for a system for protecting a money-handling unit vulnerable to liquid, the method comprising sensing one or more characteristics suitable for the detection of at least certain liquids, determining from at least one sensed characteristic whether a liquid of a first type is present and, if so, carrying out a first of a plurality of predetermined courses of action to respond to the detected liquid, and detecting from at least one sensed characteristic whether a liquid of a second type is present and, if so, carrying out a second of the plurality of predetermined courses of action to respond to the detected liquid.

50. A method according to claim 49, wherein an electrical characteristic is sensed.

51. A method of operation for a system for protecting a money-handling unit which is vulnerable to liquid, the method comprising detecting the presence of liquid, selecting one of a plurality of predetermined different courses of action to respond to detected liquid in dependence on a sensed characteristic of the liquid, and carrying out the selected course of action in response to the detected liquid.

52. A method according to claim 51, wherein an electrical characteristic is sensed.

53. A method of operation for use in a system for protecting a money-handling unit which is vulnerable to liquid, the method comprising sensing a characteristic suitable for detecting the presence of liquid and for distinguishing between at least certain types of liquid, and deriving therefrom first information indicative of whether a liquid is present, and second information for distinguishing between different detected liquids.

54. A method according to claim 53, wherein an electrical characteristic is sensed.

55. A method according to claim 54 wherein the electrical characteristic is conductivity.

56. A method of operation for use in a system for protecting a money-handling unit which is vulnerable to liquid, the method enabling different liquids to be distinguished from each other and comprising sensing electrical conductivity and producing an electrical signal indicative of the magnitude thereof, comparing the sensed signal with first and second thresholds, and producing a first output signal if the sensed signal exceeds the first threshold, a second output signal if the sensed signal exceeds the second threshold, and a third output signal if the sensed signal does not exceed either threshold.

* * * * *